US010332493B2

(12) United States Patent
Moberg et al.

(10) Patent No.: US 10,332,493 B2
(45) Date of Patent: Jun. 25, 2019

(54) ILLUMINATED MUSICAL INSTRUMENT DISPLAY

(71) Applicants: Alan Moberg, Oceanside, CA (US); Chris Moberg, Oceanside, CA (US)

(72) Inventors: Alan Moberg, Oceanside, CA (US); Chris Moberg, Oceanside, CA (US)

( * ) Notice: Subject to any disclaimer, the term of this patent is extended or adjusted under 35 U.S.C. 154(b) by 0 days.

(21) Appl. No.: 16/166,388

(22) Filed: Oct. 22, 2018

(65) Prior Publication Data

US 2019/0066638 A1 Feb. 28, 2019

Related U.S. Application Data

(60) Provisional application No. 62/605,676, filed on Aug. 22, 2017.

(51) Int. Cl.

| | |
|---|---|
| ***G10G 5/00*** | (2006.01) |
| ***A47F 7/00*** | (2006.01) |
| ***F21V 33/00*** | (2006.01) |
| *F21Y 115/10* | (2016.01) |
| *F21W 131/30* | (2006.01) |

(52) U.S. Cl.

CPC ..... *G10G 5/00* (2013.01); *A47F 7/00* (2013.01); *F21V 33/0056* (2013.01); *F21W 2131/30* (2013.01); *F21Y 2115/10* (2016.08)

(58) Field of Classification Search

CPC ..... G10G 5/00; A47F 7/00; F21V 33/0056; F21Y 2115/10; F21W 2131/30

See application file for complete search history.

(56) References Cited

U.S. PATENT DOCUMENTS

| | | | | | |
|---|---|---|---|---|---|
| 1,669,523 | A * | 5/1928 | Isecoff | G10G 5/00 | 24/331 |
| 4,176,580 | A * | 12/1979 | Gallegos | G10G 5/00 | 248/224.51 |
| 4,182,505 | A * | 1/1980 | Cobin | F16M 13/00 | 150/154 |
| 6,231,018 | B1 * | 5/2001 | Barbieri | G10G 5/00 | 248/302 |
| 6,464,189 | B1 * | 10/2002 | Yu | G10G 5/00 | 248/221.11 |
| 6,481,677 | B1 * | 11/2002 | Yu | A47F 5/083 | 211/59.1 |
| 6,685,283 | B2 * | 2/2004 | Gembar | A47F 3/00 | 248/176.1 |
| 6,959,810 | B2 * | 11/2005 | Neilson | A45C 11/24 | 206/204 |

(Continued)

*Primary Examiner* — Robert W Horn

(74) *Attorney, Agent, or Firm* — Marshall, Gerstein & Borun LLP

(57) ABSTRACT

A musical instrument holder capable of holding and displaying an instrument includes a housing, a hook, an illumination device, and a mounting device. The housing includes a cavity formed within one side of the housing. The hook is for hanging the musical instrument on display and is carried by the housing. Additionally, the hook projects from a front surface to the housing. The illumination device is disposed at a lower surface of the housing and is adapted to project light below the holder and behind the musical instrument when the musical instrument is hung. Finally, the mounting device is carried by the housing and mounts the musical instrument holder to a supporting wall surface.

20 Claims, 4 Drawing Sheets

(56) References Cited

U.S. PATENT DOCUMENTS

| | | | | |
|---|---|---|---|---|
| 7,090,313 | B1 * | 8/2006 | McMurray | A47F 3/005 312/114 |
| 7,146,760 | B2 * | 12/2006 | Yiu | A47F 3/001 40/743 |
| 7,290,653 | B2 * | 11/2007 | Izen | A47F 7/00 206/314 |
| 7,579,537 | B2 * | 8/2009 | Lippert | G10G 5/00 84/327 |
| 7,772,471 | B2 * | 8/2010 | Bustamante | G10G 5/00 84/327 |
| 8,038,109 | B2 * | 10/2011 | Ashford | G10G 5/00 248/150 |
| 8,763,961 | B1 * | 7/2014 | Yang | G10G 5/00 248/122.1 |
| 9,295,326 | B2 * | 3/2016 | Sassman | F16B 11/006 |
| 2009/0242499 | A1 * | 10/2009 | Rosselli | A47F 7/00 211/85.6 |
| 2015/0122960 | A1 * | 5/2015 | Eward | G10G 5/00 248/231.91 |
| 2017/0263224 | A1 * | 9/2017 | Anderson | G10G 5/00 |
| 2019/0066638 | A1 * | 2/2019 | Moberg | G10G 5/00 |

* cited by examiner

ILLUMINATED MUSICAL INSTRUMENT DISPLAY

CROSS-REFERENCE TO RELATED APPLICATIONS

Priority is claimed to U.S. Provisional Patent Application No. 62/605,676, filed Aug. 22, 2017, the entire contents of which are hereby incorporated by reference.

FIELD OF THE DISCLOSURE

The present disclosure generally relates to instrument displays and, more particularly, to illuminated instrument displays that are mounted to a surface.

BACKGROUND

Musical instruments are commonly placed in storage cases to protect the instruments from damage and to keep the musical instruments clean. Once placed in cases, the musical instruments are often tucked away and stored out of sight. However, some instruments are made using painstaking and time consuming manufacturing processes. Such processes include handcrafting various string instruments such as violins, cellos, and guitars, or various brass instruments such as trumpets or French horns. An owner of such an instrument might want to display the instrument because of the craftsmanship that went into making the instrument, rather than putting the instrument into a case.

To remedy this, owners can turn to stands that sit on the floor and hold the instrument. For example, a guitar stand typically includes a base to prevent the instrument and stand from tipping and a portion that extends vertically from the base to hold the instrument. However, placing instruments in such stands that sit on the floor causes clutter and may take away from the presentation of the instrument. Thus, existing musical instrument displays add clutter and take up considerable amount of space in addition to interfering with the aesthetic display of the musical instrument.

SUMMARY

An illuminated musical instrument display includes a musical instrument holder for holding and displaying an instrument. The musical instrument holder includes a housing, a hook, an illumination device, and a mounting device. A cavity is formed within a portion of the housing and receives the illumination device. The hook is carried by the housing and projects from a front surface of the housing. An instrument may be hung from the hook. The illumination device is disposed at a lower surface of the housing and is adapted to project light below the holder and behind the musical instrument when the musical instrument is hung. The mounting device is carried by the housing and mounts the musical instrument holder to a supporting wall surface.

BRIEF DESCRIPTION OF THE DRAWINGS

The features of this disclosure which are believed to be novel are set forth with particularity in the appended claims. The present disclosure may be best understood by reference to the following description taken in conjunction with the accompanying drawings, in which like reference numerals identify like elements in the several figures, in which:

DETAILED DESCRIPTION

Figure 1:
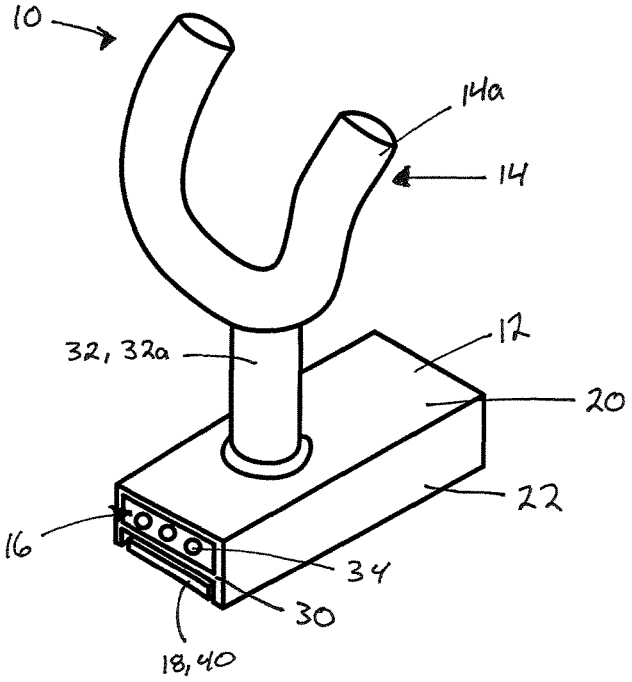
FIG. 1 is a perspective view of an example illuminated instrument display bracket constructed in accordance with the present disclosure.
Figure 2:
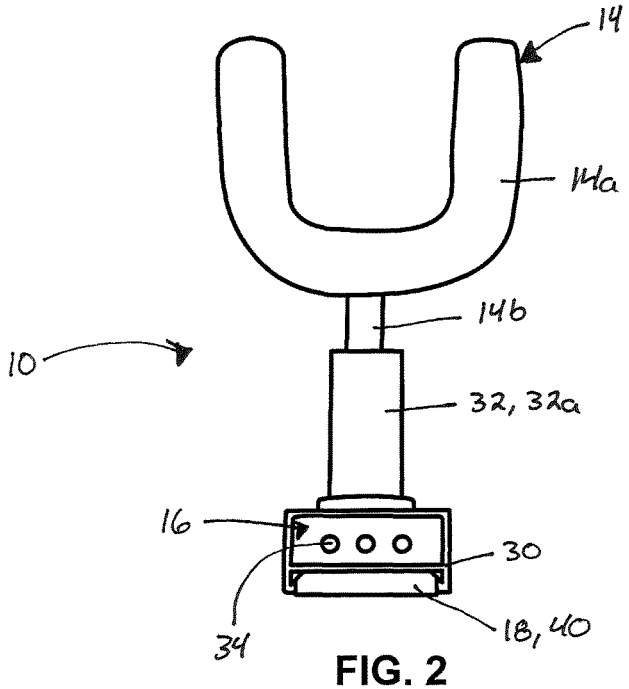
FIG. 2 is a bottom view of the example illuminated instrument display bracket depicted in FIG. 1.
Figure 3:
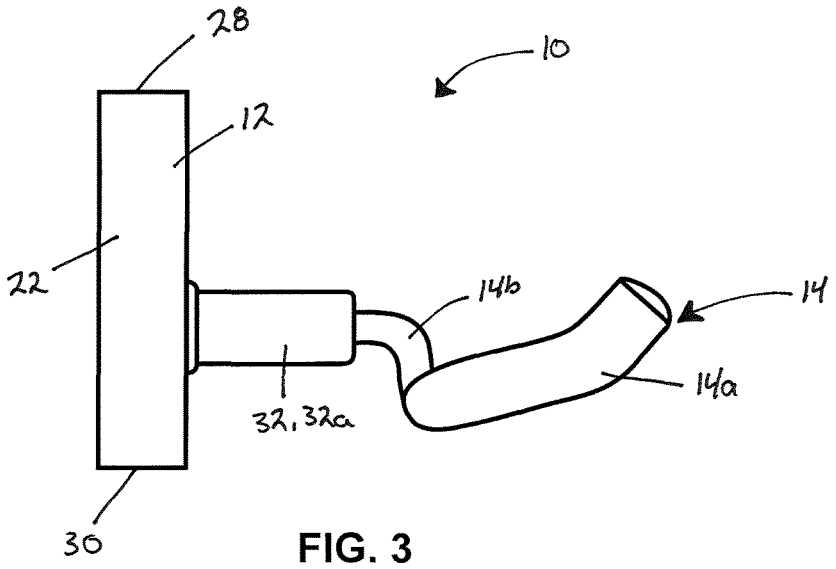
FIG. 3 is a side view of the example illuminated instrument display bracket depicted in FIG. 1.

The present disclosure is generally directed to an instrument display and, in particular, to an illuminated musical instrument display bracket. The instrument display can be mounted to a surface, such as a wall, thus raising the instrument off the ground eliminating clutter. The instrument display may also include an illumination device to illuminate the instrument held by the instrument display. The illumination device also aids in the aesthetic presentation of the instrument in a store display or at home, for example.

FIGS. 1-5 depicts an example of an illuminated instrument display bracket 10 including a housing 12, a hook 14 carried by the housing 14, an illumination device 16, and a mounting device 18 carried by the housing 14. The housing 14 includes a front surface 20, at least one side surface 22, and the mounting device 18, and may take the form of a shape that is readily hidden behind an instrument 11 carried by the instrument display 10. For example, the housing 12 in the depicted version takes the shape of a rectangle. In such an example, the rectangularly shaped housing can be readily hidden behind the head and/or neck of a guitar. In other examples, however, the housing 12 may take the form of a square, circle, oval, or triangle. Additionally, a cavity 24 is formed within a rear surface 26 of the housing 12, opposite the front surface 20 of the housing 12. The cavity 24 may take the form of a shape substantially similar to the housing 12. In particular, if, for example, the housing 12 is rectangular, the cavity 24 can also take the form of a rectangle. The cavity 24 may extend from a top surface 28 of the housing 12 up to, and through, a bottom surface 30 of the housing 12 and between a first and second side 22 of the housing. In other examples, the cavity 24 can extend from the bottom surface 30 up and through the top surface 28, and between a first and second side 22 of the housing 12. Thus, the cavity 24 creates a hollow area in the housing 12 capable of hiding electronic components (e.g., a power source, a controller, one or more drivers, etc.) of the illumination device 16.

In addition to the cavity 24, the housing 12 includes a structure 32 that extends perpendicularly from the front surface 20 of the housing 12. In particular, the structure 32 can receive a portion of the hook 14. For example, the structure 32 can be an elongated cylinder 32*a* with a hollow core 32*b*. In such an example, the hollow core 32*b* extends through the housing 12 creating a passage through the elongated cylinder 32*a* to the cavity 24 of the housing 12.

The elongated cylinder 32*a* may be integrally formed with the housing 12. However, in other examples, the elongated cylinder 32*a* may be attached to the housing 12. In particular, the elongated cylinder 32*a* may be attached to the housing 12 using an adhesive. The elongated cylinder 32*a* may also be attached to the housing 12 by mechanical means. For example, the elongated cylinder 32*a* may be attached to the house 12 by screwing one end of the elongated cylinder 32*a* into an aperture of the housing 12, by tongue and groove, or by snap fit. The housing 12 and elongated cylinder 32*a* (herein "housing") may be formed using an injection molded plastic. Additionally, the housing 12 may be formed of a wood, a plastic, a metal, or a composite material, for example, or any other suitable material.

The hook 14 is carried by the housing 12 and includes an engagement portion 14*a* and a support portion 14*b*. The engagement portion 14*a* holds the instrument 11 to be displayed and the support portion 14*b* is coupled to the engagement portion 14*a*. The engagement portion 14*a* and the support portion 14*b* may be integrally formed to increase the strength, and overall carrying capacity. Additionally, the support portion 14*b* may be integrally formed with the housing 12 to increase the strength, and overall carrying capacity of the hook 14. However, the engagement portion 14*a* and the support portion 14*b* may be formed separately and later joined. For example, the engagement portion 14*a* can include a threaded portion and the support portion 14*b* can include a threaded bore that receives the threaded portion of the engagement portion 14*a*. In such an example, various engagement portions 14*a* may be attached to a threaded portion of the support portion 14*b*. Such a feature allows for instruments having various shapes to be held by the instrument display 10.

The engagement portion 14*a* may take any shape capable of holding the instrument 11 to be displayed. For example, the engagement portion 14*a* can be lyre shaped hooks, v-shaped hooks, c-shaped hooks, u-shaped hooks, or an s-shaped hook to hold multiple instruments. The engagement portion 14*a* may also include a coating to prevent damaging the instrument 11 while it is in contact with the hook 14. In particular, the engagement portion 14*a* may be at least partially covered with a non-abrasive material. For example, the non-abrasive material can be a foam. The engagement portion 14*a* may also include a coating to prevent the instrument 11 from slipping or sliding out from the engagement portion 14*a*. In particular, the engagement portion 14*a* may be at least partially covered with a non-slip material. For example, the non-slip material can be a rubber, felt, foam, fabric, silicone, Dycem, or another suitable material.

The engagement portion 14*a* and the support portion 14*b* may also be rigid, so as to maintain their shape when holding the instrument 11. However, in other examples, the support portion 14*b* can be rigid and the engagement portion 14*a* can be flexible. In such an example, the engagement portion 14*a* can be manipulated to securely engage the instrument 11. Thus, an instrument having a shape that does not lend itself to be held by a hook may be securely engaged by the engagement portion 14*a* of the hook 14. Additionally, a flexible engagement portion may allow an instrument to be displayed at various angles without the need for an additional element to secure the instrument to the hook 14.

As discussed above, the hook 14 is carried by the housing 12. In particular, the support portion 14*b* is carried by the structure 32 extending perpendicularly from the front surface 20 of the housing 12. For example, the elongated cylinder 32*a* can receive the support portion 14*b* of the hook 14. A portion of the support portion 14*b* extends through the hollow core 32*b* of the elongated cylinder 32*a* and extends through to the cavity 24. The support portion 14*b* may then be attached to the housing 12 by a securing mechanism disposed within the cavity 24. For example, an end of the support portion 14*b* can extend into the cavity 24 and be attached to the housing 12 via the securing mechanism. In such an example, the securing mechanism may be a threaded nut that engages a threaded portion of the end of the support portion. In other examples, the support portion 14*b* can include a threaded portion that engages a threaded portion inside of elongated cylinder's hollow core 32*b*.

The illumination device 16 is disposed on the bottom surface 30 of the housing 12. In particular, at least one aperture 34 is disposed in the bottom surface 30 of the housing 12 to allow the illumination device 16 to pass from the cavity 24 through the bottom surface 30 of the housing 12. The illumination device 16 may be a variety of light emitting devices that do not cause damage to the instrument 11 being held by the instrument display 10. For example, the illumination device 16 can be at least one light emitting diode ("LED"). In such an example, the at least one LED is placed in the cavity 24 and inserted through the at least one aperture 34 to illuminate the instrument 11. The at least one LED may emit a single color of light steadily when turned on. However, in other examples, the at least on LED can emit multiple colors of light (e.g., red, green, blue, orange, pink, etc.). In such an example, the at least one LED can include multiple LEDs all of the same color (e.g., orange) or, in other examples, can include multiple LEDs of various colors (e.g., red, green, blue). Additionally, the at least one LED may emit light in various patterns. For example, the at least one LED can emit a flash, a strobe, or a specific pattern that a user inputs. While the illumination device 16 has been discussed as being disposed on the bottom surface 30 of the housing 12, the illumination device 16 may also be disposed on the top surface 28 of the housing 12, if desired for illuminating instruments that might stand on top of the hook. Additionally, the illumination device 16 may be disposed on both the top and bottom surfaces 28, 30, thus, projecting light both above and below the housing 12 and instrument.

Figure 7:
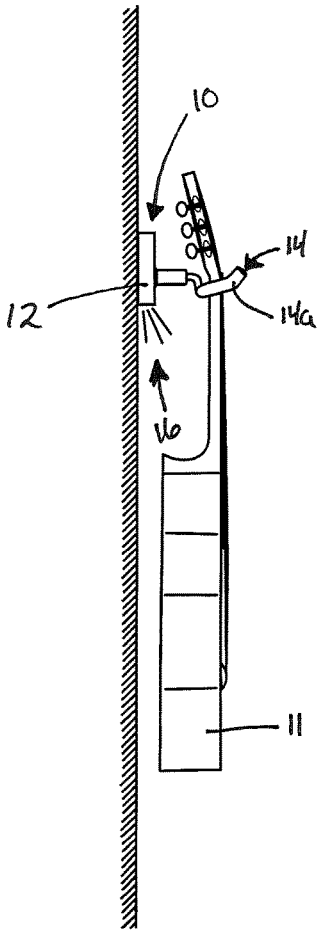
FIG. 7 is a side view of an example of a musical instrument display system constructed in accordance with the present disclosure.
Figure 8:
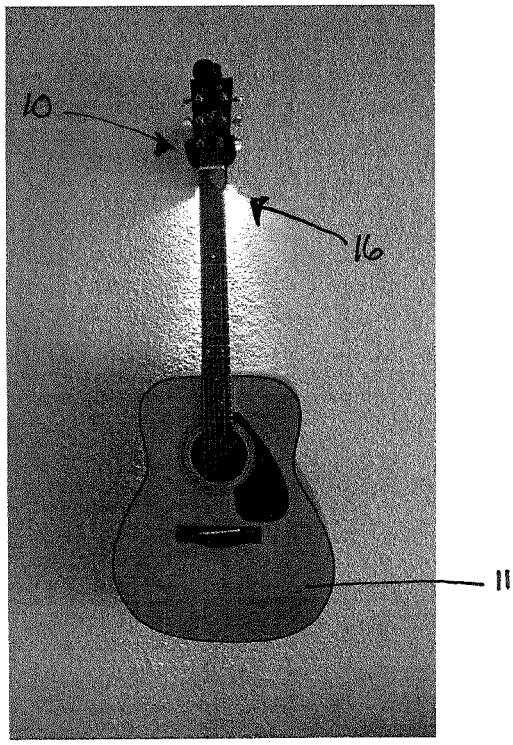
FIG. 8 is a front view of the musical instrument display system of FIG. 7 with an illumination device emitting light.

As best depicted in FIGS. 7 and 8, the illumination device 16 projects a pattern of light below the holder 10 and behind the instrument 11 when the instrument 11 is hung. The illumination device 16 provides a light distribution pattern in the shape of a fan to provide a dramatic effect behind the instrument. In some examples, the illumination device 16 provides a soft backlight. In other examples, however, the illumination device 16 may provide a stronger light source that has a greater dispersion of light. Such an illumination device 16 may be useful in a storefront display where a great amount of light may be required to properly illuminate the instrument on display.

Additionally, the illumination device 16 includes a power source 36. The power source 36 may be stored within the cavity 24 and, thus, hidden from view. In such an example, the power source 36 can be a battery. However, the power source 36 may be located externally from the housing 12. For example, the illumination device 16 can be directly plugged into a power outlet or, if used in a windowed storefront display, electronically coupled to a solar panel.

Figure 4:
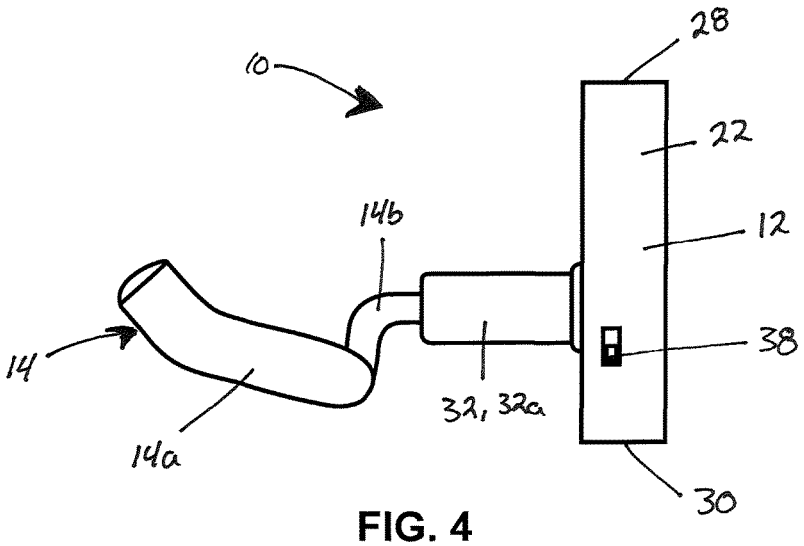
FIG. 4 is another side view of the example illuminated instrument display bracket depicted in FIG. 1.

Once the power source 36 is provided, the illumination device 16 may be turned on. In particular, the illumination device 16 may be turned on and off using a switch 38, as depicted in FIG. 4. However, other means may be used. For example, the illumination device 16 can be turned on remotely. In such an example, the illumination device 16 includes an transceiver (not depicted) capable of wireles sly communicating with a Bluetooth remote. Additionally, the Bluetooth remote may be capable of wireles sly communicating with at least two illumination devices 16 disposed in separate housings 12. Such a feature allows multiple instrument displays 10 to be turned on and off, either, selectively or all at once. Using a remote also decreases the likelihood that the instrument 11 is knocked off the instrument display 10 when a user turns off the illumination device 16 using a switch.

Figure 5:
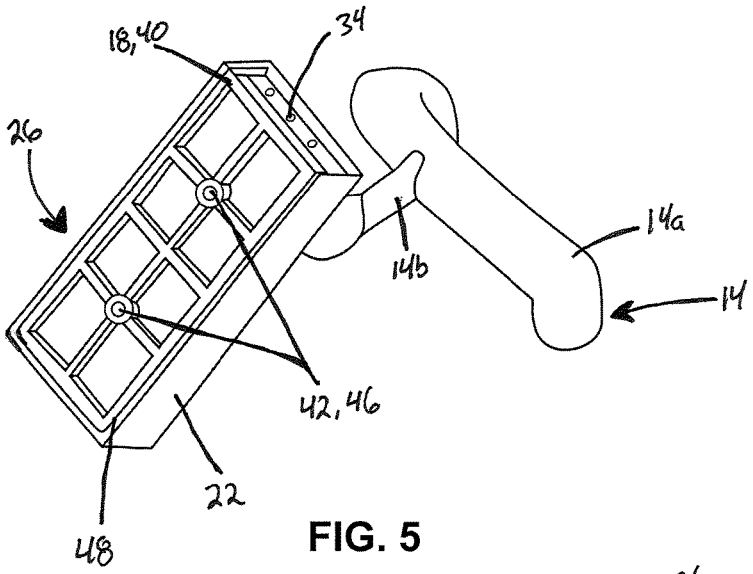
FIG. 5 is an isometric view of the example illuminated instrument display bracket depicted in FIG. 1.
Figure 6:
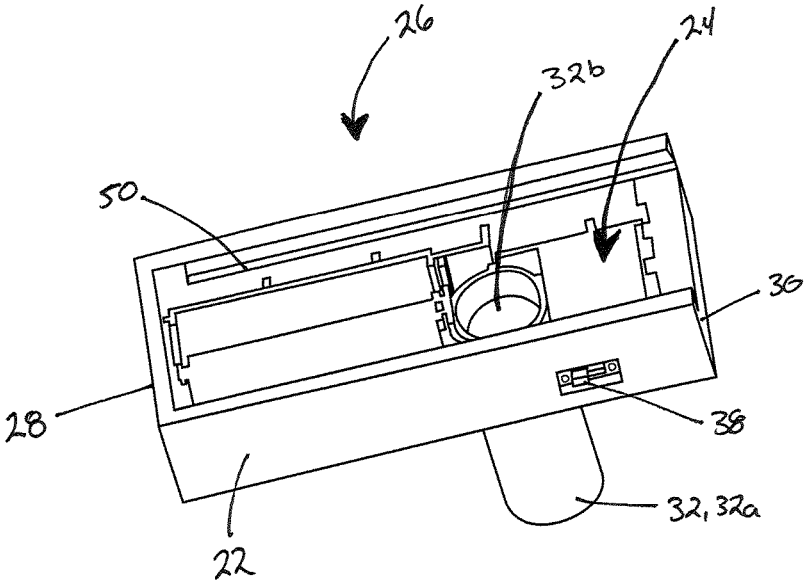
FIG. 6 is a perspective view of the example illuminated instrument display bracket depicted in FIG. 1 with a back piece and holder removed.

Finally, the mounting device 18 carried by the housing 12 mounts the instrument display 10 to a surface as depicted in FIGS. 7 and 8. In particular, the mounting device 18 may be a back mounting plate 40 that attaches to the housing 12. In such an example, the back mounting plate 40 takes a substantially similar shape as the housing 12. As depicted in FIG. 5, the back mounting plate 40 may take the form of a rectangle that is received by the housing 12. The back mounting plate 40 includes a first at least one securing element 42 for attaching the back mounting plate 40 to a surface (e.g., a wall) and a second securing element 44 for releasably attaching the housing 12 to the back mounting plate 40. The first at least one securing element 42 may take the form of any known securing mechanism for attachment to a surface. In particular, the first at least one securing element 42 may be a fastener. In such an example, the back mounting plate 40 can include at least one aperture 46 for receiving the fastener, as depicted in FIG. 5. The fastener may be a screw that is threaded through the at least one aperture 46. In other examples, the first at least one securing element 42 can be an adhesive. In particular, the adhesive may be a multiple use adhesive that allows the back mounting plate 40 to be placed on a first surface, removed from the first surface, and then placed on a second surface using the same adhesive. However, the adhesive may also be a single use adhesive that allows the back mounting plate 40 to be affixed to only a single surface (e.g., a wall).

The back mounting plate 40 may be attached to the housing 12 in a variety of ways using the second securing element 44. For example, the back mounting plate 40 can be slidably received by the housing 12. In such an example, the second securing element 44 can be a tongue that projects from at least one side 48 of the back mounting plate 40 and engages a groove 50 of the housing 12 such that the housing 12 slides onto the back mounting plate 40 in a first direction and slides off of the back mounting plate 40 in second direction that is opposite the first direction. For example, the housing 12 can be slid onto the back mounting plate 40 in a first vertical direction and slid off the back mounting plate 40 in a second vertical direction that is opposite the first vertical direction. In such an example, the tongue and groove does not allow the housing 12 to move, relative to the back mounting plate 40, in a horizontal direction. In another example, the housing 12 can slide on to the back mounting plate 40 in a horizontal direction the same way the housing 12 can slide onto the back mounting plate 40 in a vertical direction as discussed above. In yet other examples, the second securing element 44 can be a hook and loop fastener, a threaded fastener, or a snap fit securing element.

Those skilled in the art will recognize that a wide variety of modifications, alterations, and combinations can be made with respect to the above described examples without departing from the scope of the disclosure, and that such modifications, alterations, and combinations are to be viewed as being within the ambit of the inventive concept.

We claim:

1. An musical instrument holder, comprising:

a housing having a cavity formed therein;

a hook carried by the housing and projecting from a front surface of the housing, the hook for hanging a musical instrument on display;

an illumination device disposed at a lower surface of the housing and adapted to project light below the holder and behind the musical instrument when the musical instrument is hung; and a mounting device carried by the housing for mounting the musical instrument holder to a supporting wall surface.

2. The musical instrument holder of claim 1, wherein the mounting device comprises a back mounting plate having a first at least one securing element for attaching the musical instrument holder to a wall and a second securing element for releasably attaching the housing to the back mounting plate.

3. The musical instrument holder of claim 2, wherein the at least one securing element is a screw or adhesive.

4. The musical instrument holder of claim 1, wherein the illumination device comprises at least one light emitting diode that emits at least one color of light and a power source disposed within the cavity of the housing to power the at least one light emitting diode.

5. The musical instrument holder of claim 4, wherein the housing further comprises a plurality of light emitting diodes and a plurality of apertures accommodating the plurality of light emitting diodes.

6. The musical instrument holder of claim 1, wherein the housing further comprises an elongated cylinder projecting perpendicularly from the front surface of the housing between the housing and the hook for supporting the hook.

7. The musical instrument holder of claim 1, wherein the hook further comprises an engagement portion integrally formed with a support portion, the engagement portion adapted to receive a musical instrument and the support portion extends through the elongated cylinder of the cylinder and releasably secures the hook to the housing.

8. The musical instrument holder of claim 1, wherein the engagement portion may be a lyre shaped hook, a v-shaped hook, a c-shaped hook, a u-shaped hook, or an s-shaped hook.

9. The musical instrument holder of claim 2, wherein the second securing element may be a hook and loop fastener, a threaded fastener, tongue and groove securing element, or a snap fit securing element.

10. The musical instrument holder of claim 7, wherein the engagement portion is at least partially covered with a non-abrasive material.

11. A musical instrument display system, comprising:

a musical instrument holder, comprising:

a housing having a cavity formed therein, a hook carried by the housing and projecting from front surface of the housing, an illumination device disposed at a lower surface of the housing, and a mounting device carried by the housing; and a musical instrument disposed on the hook and hanging therefrom such that the illumination device when illuminated is adapted to project light below the instrument holder and behind the musical instrument.

12. The musical instrument display system of claim 11, wherein the mounting device comprises a back mounting plate having a first at least one securing element for attaching the musical instrument holder to a wall and a second securing element for releasably attaching the housing to the back mounting plate.

13. The musical instrument display system of claim 12, wherein the at least one securing element is a screw or adhesive.

14. The musical instrument display system of claim 11, wherein the illumination device comprises at least one light emitting diode that emits at least one color of light and a power source disposed within the cavity of the housing to power the at least one light emitting diode.

15. The musical instrument display system of claim 14, wherein the housing further comprises a plurality of light emitting diodes, and a plurality of apertures accommodating the plurality of light emitting diodes.

16. The musical instrument display system of claim 14, wherein the housing further comprises an elongated cylinder projecting perpendicularly from the front surface of the housing between the housing and the hook for supporting the hook.

17. The musical instrument display system of claim 14, wherein the hook further comprises an engagement portion integrally formed with a support portion, the engagement portion engaging the musical instrument.

18. The musical instrument display system of claim 11, wherein the engagement portion comprises a lyre shaped hook, a v-shaped hook, a c-shaped hook, a u-shaped hook, or an s-shaped hook.

19. The musical instrument display system of claim 12, wherein the second securing element comprises a hook and loop fastener, a threaded fastener, tongue and groove securing element, or a snap fit securing element.

20. The musical instrument display system of claim 11, wherein the engagement portion is at least partially covered with a non-abrasive material.

* * * * *